US011473825B1

(12) United States Patent
Wang

(10) Patent No.: US 11,473,825 B1
(45) Date of Patent: Oct. 18, 2022

(54) ICE BUCKET WITH A SPRAY AND LIGHT-EMITTING FUNCTION

(71) Applicant: Rui Wang, Ningbo (CN)

(72) Inventor: Rui Wang, Ningbo (CN)

( * ) Notice: Subject to any disclaimer, the term of this patent is extended or adjusted under 35 U.S.C. 154(b) by 0 days.

(21) Appl. No.: 17/525,891

(22) Filed: Nov. 13, 2021

(30) Foreign Application Priority Data

Oct. 18, 2021 (CN) ..... 202122507753.X

(51) Int. Cl.

| | |
|---|---|
| ***F25D 3/06*** | (2006.01) |
| ***F21S 9/02*** | (2006.01) |
| ***B05B 17/06*** | (2006.01) |
| ***F21V 33/00*** | (2006.01) |
| ***F21V 23/04*** | (2006.01) |

(52) U.S. Cl.
CPC ..... *F25D 3/06* (2013.01); *B05B 17/0653* (2013.01); *F21S 9/02* (2013.01); *F21V 23/04* (2013.01); *F21V 33/0004* (2013.01)

(58) Field of Classification Search
CPC ..... F25D 3/06; B05B 17/0653; F21V 23/04; F21V 33/0004; F21S 9/02
See application file for complete search history.

(56) References Cited

U.S. PATENT DOCUMENTS 7,748,235 B1 * 7/2010 Franklin ..... F24F 5/0017 62/414
2015/0219389 A1 * 8/2015 Schaefer ..... A47F 3/0426 362/94

* cited by examiner

*Primary Examiner* — Thomas M Sember
(74) *Attorney, Agent, or Firm* — Li & Cai Intellectual Property (USA) Office

(57) ABSTRACT

An ice bucket with a spray and light-emitting function comprises: a transparent housing and a light-transmitting base supporting the housing, wherein the housing is separated from an ice storage chamber and a mist generating chamber by a partition plate, the ice storage chamber are in partial communication with the mist generating chamber via the partition plate and the mist generating chamber is in communication with the base through an air duct, and wherein the base is provided with a power source, a lamp, an atomizer, and a fan, the lamp, the atomizer, and the fan are electrically connected to a power source, the fan is configured to blow a mist generated by the atomizer out of the mist generating chamber through the air duct and guide the atomizer to the ice storage chamber, and a light generated by the lamp is irradiated to the housing through the base.

10 Claims, 3 Drawing Sheets

ICE BUCKET WITH A SPRAY AND LIGHT-EMITTING FUNCTION

FIELD OF THE DISCLOSURE

The present disclosure relates to an ice bucket with a spray and light-emitting function.

BACKGROUND OF THE DISCLOSURE

An ice bucket is a storage bucket that is filled with ice and water to cool the wine and other drinks that need to be tasted in a cold state. When the temperature of drinks such as wine is above the optimum drinking temperature, the ice bucket can reduce the temperature of such drinks to the optimum within a few minutes.

The ice bucket is frequently used as a daily necessity, and mist of the ice buckets in the prior art are just containers that can hold ice cubes and drinks, or there are some ice buckets that can emit light and mist, but the structure is usually complicated and the misting effect is not good.

SUMMARY OF THE DISCLOSURE

In view of the above-mentioned existing conditions, the purpose of the present disclosure is to provide an ice bucket with better misting effect and spray and light-emitting function.

For this reason, the present disclosure provides an ice bucket with a spray and light-emitting function, comprising: a transparent housing and a light-transmitting base supporting the housing, wherein the housing is separated from an ice storage chamber and a mist generating chamber by a partition plate, the ice storage chamber are in partial communication with the mist generating chamber vis a part of the partition plate, and the mist generating chamber is in communication with the base through an air duct, and wherein the base is provided with a power source, a lamp, an atomizer, and a fan, the lamp, the atomizer, and the fan are electrically connected to a power source, the fan is configured to blow a mist generated by the atomizer out of the mist generating chamber through the air duct and guide the mist to the ice storage chamber, and a light generated by the lamp is irradiated to the housing through the base.

In a preferred embodiment of the present disclosure, the housing is separated from the ice storage chamber and the mist generating chamber by a partition plate, which can isolate the ice in the mist generating chamber and the ice storage chamber and can make the mist rise faster; furthermore, by installing a fan and n air duct, a mist in the mist generating chamber can be accelerated to be blown out. In this case, the structure not only enables the ice bucket to have misting and luminous effects, but also has better misting effect.

In a preferred embodiment of the present disclosure, the atomizer is composed of a plurality of ultrasonic atomization sheets, and the plurality of ultrasonic atomization sheets are evenly distributed on a surface of the base facing the mist generating chamber. As a result, the amount of mist can be increased.

In a preferred embodiment of the present disclosure, the atomizer is composed of a plurality of microporous atomizing sheets, and the plurality of microporous atomizing sheets are evenly distributed on a surface of the base facing the mist generating chamber. As a result, the mist generation rate can be increased while increasing the amount of mist generation.

In a preferred embodiment of the present disclosure, the lamp is a strip-shaped light strip, the light strip is arranged on a bottom surface of the base, and a light emitted by the light strip is evenly guided to the transparent housing. As a result, the light emitting effect can be enhanced.

In a preferred embodiment of the present disclosure, the lamp is a plurality of lamp beads, the plurality of lamp beads are evenly arranged on a bottom surface of the base, and a light emitted by the plurality of lamp beads is evenly guided to the transparent housing. As a result, the light emitting effect can be enhanced.

In a preferred embodiment of the present disclosure, it further comprises: a housing cover arranged on the housing, and the housing cover is hinged with the housing through a hinge. As a result, the objects in the housing can be conveniently protected.

In a preferred embodiment of the present disclosure, a charging port and a power switch are provided on the base. As a result, it is possible to facilitate charging use and switch control.

In a preferred embodiment of the present disclosure, the power source is a battery. As a result, it is convenient to use it multiple times after charging.

In a preferred embodiment of the present disclosure, an outer shape of the housing is one of a cuboid, a cube and a cylinder. As a result, it is possible to manufacture an appropriate housing shape according to requirements.

In a preferred embodiment of the present disclosure, the housing and the base are connected by one of snapping, bonding, bolts, pins, and sliding buckles. As a result, it is possible to facilitate the fitting connection of the housing and the base.

In the present disclosure, the housing is separated from the ice storage chamber and the mist generating chamber by the partition plate, which can isolate the ice in the mist generating chamber and the ice storage chamber, and can make the mist rise faster; furthermore, by installing a fan and an air duct, a mist in the mist generating chamber can be accelerated to be blown out. In this case, the structure not only enables the ice bucket to have misting and luminous effects, but also has better misting effect.

BRIEF DESCRIPTION OF THE DRAWINGS

The embodiments of the present disclosure will now be explained in further detail only by referring to the examples of the accompanying drawings.

Figure 1:
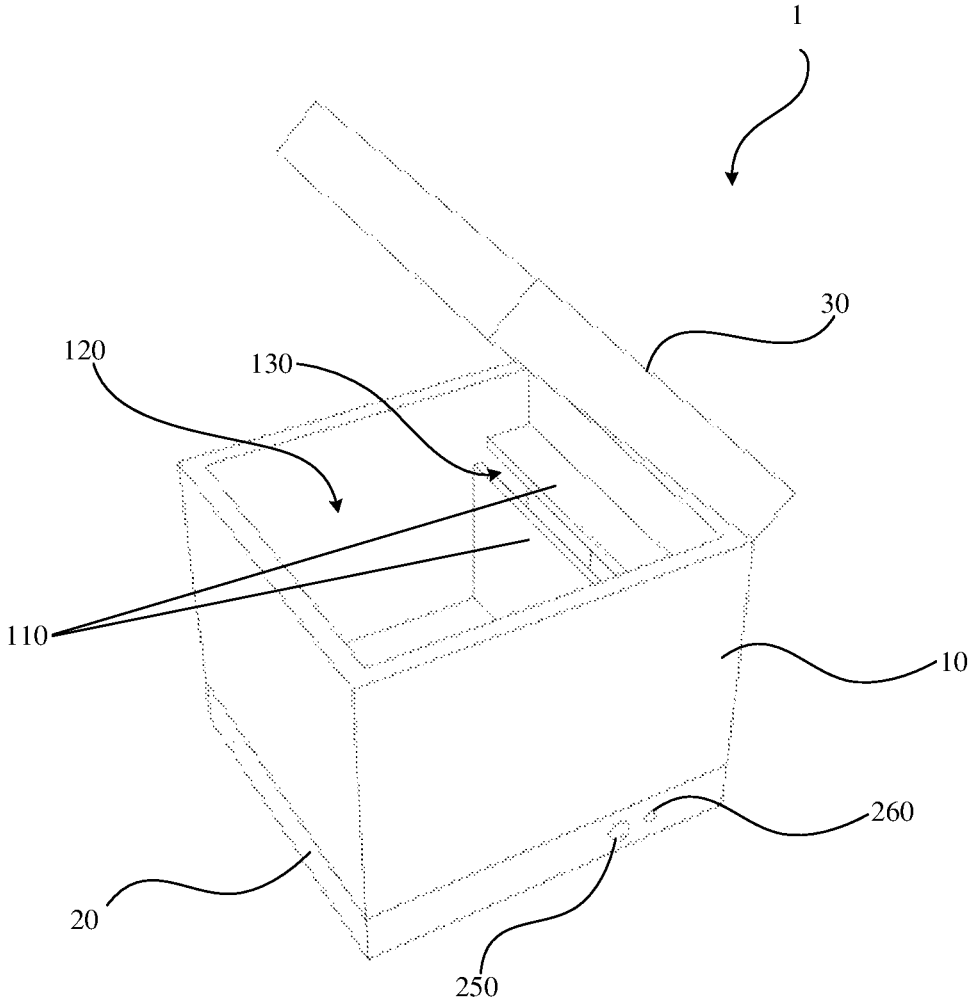
FIG. 1 is a schematic diagram showing the overall structure of the ice bucket involved in the present disclosure from a perspective.

Reference numeral: 1. ice bucket, 10. housing, 20. base, 30. housing cover, 110. partition plate, 120. ice storage chamber, 130. mist generating chamber, 140. air duct, 210. power source, 220. lamp, 230. atomizer, 240. fan, 250. power switch, 260. charging port.

DETAILED DESCRIPTION OF THE EXEMPLARY EMBODIMENTS

Hereinafter, the preferred embodiments of the present disclosure will be described in detail with reference to the drawings. In the following description, the same symbols are assigned to the same components, and repeated descriptions are omitted. In addition, the drawings are only schematic diagrams, and the ratio of the dimensions between the components or the shapes of the components may be different from the actual ones.

Figure 2:
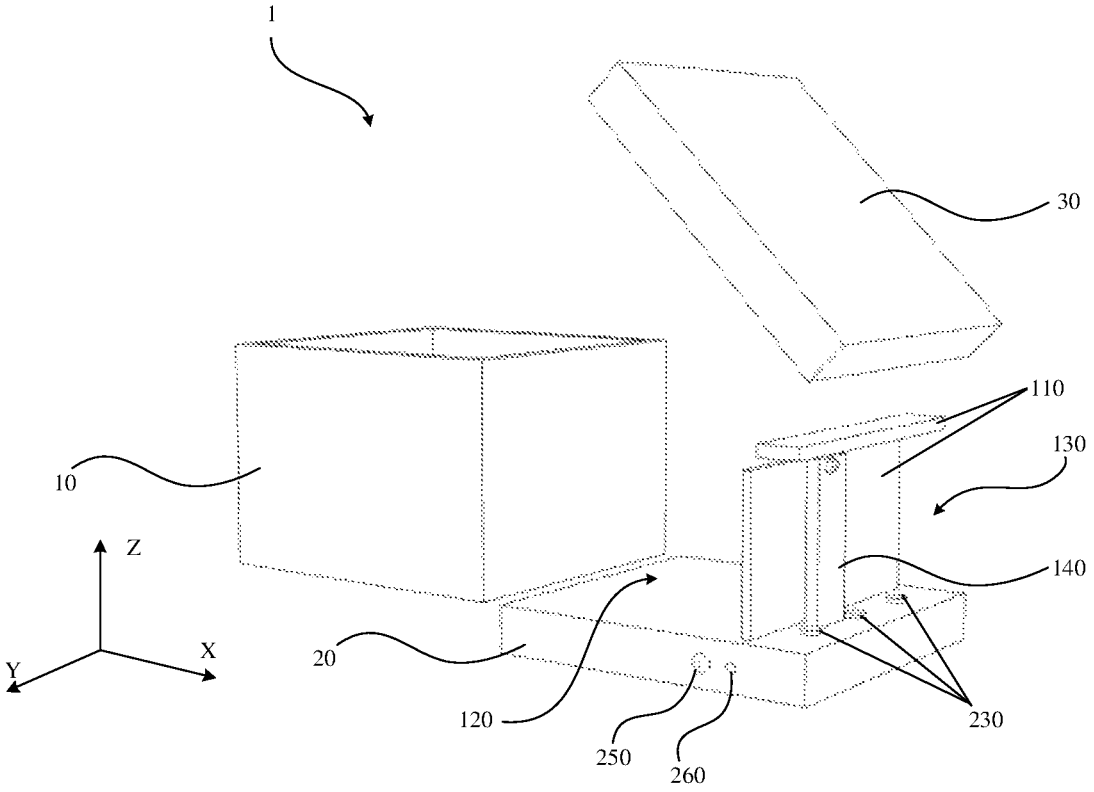
FIG. 2 is an exploded view showing the ice bucket involved in the present disclosure.
Figure 3:
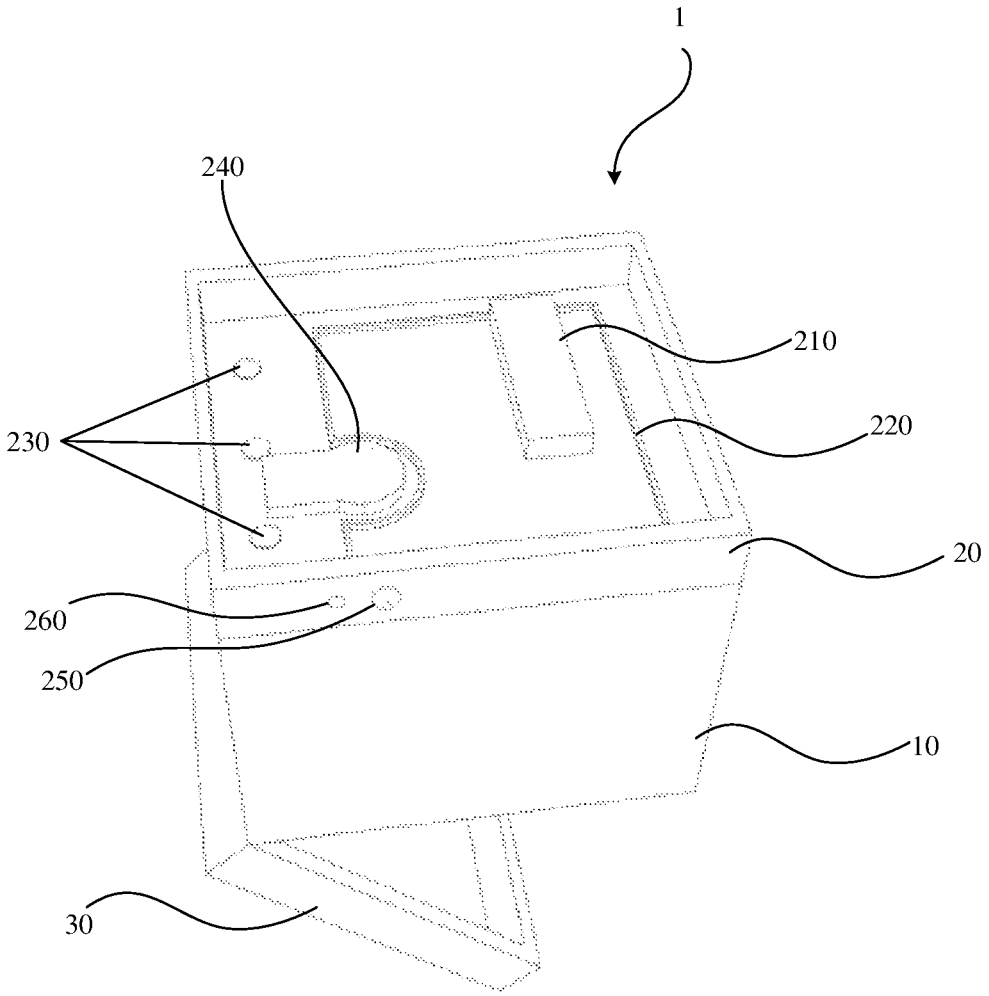
FIG. 3 is a schematic diagram showing the overall structure of the ice bucket involved in the present disclosure from another perspective.

FIG. 1 is a schematic diagram showing the overall structure of the ice bucket involved in the present disclosure from a perspective. FIG. 2 is an exploded view showing the ice bucket involved in the present disclosure. FIG. 3 is a schematic diagram showing the overall structure of the ice bucket involved in the present disclosure from another perspective.

Reference is made to FIGS. 1 to 3, an ice bucket 1 involved in the present disclosure can be used to cool drinks such as wine, beer, etc. The ice bucket 1 can be used in karaoke halls, dance halls, parties and other places to enhance the atmosphere. The ice bucket 1 (hereinafter referred to as the ice bucket) with spray light-emitting function involved in the present embodiment may include a housing 10 and a base 20. The housing 10 may be separated from an ice storage chamber 120 and a mist generating chamber 130 by a partition plate 11, and a power source 210, a lamp 220, an ultrasonic atomizer 230, and a fan 240 may be provided on the base 20.

Specifically, in the present embodiment, the ice bucket 1 may include a transparent housing 10 and a light-transmitting base 20 supporting the housing 10. The internal space of the housing 10 may be separated from the ice storage chamber 120 and the mist generating chamber 130 by a partition plate 110, and the ice storage chamber 120 and the mist generating chamber 130 may be partially connected through the partition plate 110. The mist generating chamber 130 may communicate with the base 20 through an air duct 140. A power source 210, a lamp 220, an ultrasonic atomizer 230, and a fan 240 may be provided on the base 20. The lamp 220, the ultrasonic atomizer 230, and the fan 240 may be electrically connected to the power source 210, respectively, and the power source 230 provides working power required by the lamp 220, the ultrasonic atomizer 230, and the fan 240. The fan 240 can be used to blow a mist generated by the ultrasonic atomizer 230 out of the mist generating chamber 130 through the air duct 140 and guide the mist to the ice storage chamber 120. A light generated by the lamp 220 can be irradiated to the housing 10 through the base 20.

In the present disclosure, the housing 10 is separated from the ice storage chamber 120 and the mist generating chamber 130 by the partition plate 110, which can isolate the ice in the mist generating chamber 130 and the ice storage chamber 120, and can make the mist rise faster; furthermore, by installing a fan 240 and an air duct 140, a mist in the mist generating chamber 130 can be accelerated to be blown out. In this case, the structure not only enables the ice bucket 1 to have misting and luminous effects, but also has better misting effect.

In some examples, the power source 210, the lamp 220, the ultrasonic atomizer 230, and the fan 240 may be attached or clipped to a bottom of the base 20. The ultrasonic atomizer 230 may pass through the base 20 and be exposed in the mist generating chamber 130.

In some embodiments, the material of the housing 10 may be made of organic glass, optical plastic, light-transmitting polymer, and the like. As a result, the light transmittance and transparency of the housing 10 can be increased.

In some embodiments, the material of the base 20 may be made of organic glass, optical plastic, light-transmitting polymer, and the like. As a result, the light transmittance of the base 20 can be increased.

In the present embodiment, the atomizer 230 may be composed of a plurality of ultrasonic atomizing sheets, and the plurality of ultrasonic atomizing sheets may be evenly distributed on the surface of the base 20 facing the mist generating bin 130. As a result, the amount of mist can be increased.

In some embodiments, the atomizer 230 may be composed of one to ten ultrasonic atomization sheets; in other embodiments, the atomizer 230 may be composed of three ultrasonic atomization sheets, and the three ultrasonic atomizing sheets may be uniformly distributed in the Y axial direction of the base 20 at equal intervals.

In some embodiments, the atomizer 230 may be composed of a plurality of microporous atomizing sheets, and the plurality of microporous atomizing sheets may be evenly distributed on the surface of the base 20 facing the mist generating chamber 130. In this case, the high-frequency vibration of the microporous atomization sheet can instantly decompose the water into small beads, which are then sprayed from the middle pores of the microporous atomization sheet and can increase the amount of mist at the same time to improve the mist generation rate.

In some embodiments, the atomizer 230 may be composed of one to ten microporous atomizing sheets; in other embodiments, the atomizer 230 may be composed of three microporous atomizing sheets, and the three microporous atomizing sheets can be evenly distributed in the Y axial direction of the base 20 at equal intervals.

In the present embodiment, the lamp 220 can be a strip-shaped light strip, which can be arranged on the bottom surface of the base (for example, it can be arranged around the bottom surface of the base), and the light emitted by the light strip is evenly directed to the transparent housing 10. As a result, the light-emitting effect of the lamp 220 can be enhanced.

In some embodiments, the lamp 220 may be a plurality of lamp beads, and the plurality of lamp beads may be evenly arranged on the bottom surface of the base (for example, they may be arranged around the bottom surface of the base), and the light emitted by the plurality of lamp beads is evenly directed to the transparent housing 10. As a result, the light-emitting effect of the lamp 220 can be enhanced.

In some embodiments, the lamp 220 may be a monochromatic light source or a multi-color light source, and the multi-color light source may be, for example, a colorful light source. As a result, the environment atmosphere can be further enhanced by the generated multi-color light.

In the present embodiment, the ice bucket 1 further includes a housing cover 30 covering the housing 10. The cover can be hinged with the housing 10 through a hinge. As a result, the objects in the housing 10 can be conveniently protected.

In the present embodiment, a charging port 260 and a power switch 250 may also be provided on the base 20. As a result, it is possible to facilitate charging use and switch control.

In some embodiments, the charging port 260 and the power switch 250 can be arranged on one surface of the two sides of the plane where the substrate 20 XZ is located, and the charging port 260 and the power switch 250 can be arranged in adjacent positions, thereby facilitating control and use of the charging port 260 and the power switch 250.

In the present embodiment, the power source 210 may be a battery. As a result, it is convenient to use it multiple times after charging. In other embodiments, the power source 210 may also be a disposable battery such as a dry battery. By setting up an independent power source (battery) in the ice bucket 1, the portability and practicality of the ice bucket can be improved.

In the present embodiment, the outer shape of the housing 10 can be one of a cuboid, a cube, a cylinder, or other irregular bodies. Correspondingly, the housing cover 30 and the base 20 can be adapted and changed according to the shape of the housing 10. As a result, a suitable shape of the housing 10 or the outer shape of the ice bucket 1 can be manufactured according to requirements, and the ice bucket 1 can be made more beautiful.

In the present embodiment, the housing 10 and the base 20 may be connected by snapping, bonding, bolts, pins, and sliding fasteners. As a result, the fitting connection of the housing 10 and the base 20 can be facilitated.

In use, the user only needs to turn on the power switch 250 or use the charging port 260 to plug in an external power supply to start the ice bucket 1. While the ice bucket 1 emits light, the fan 240 blows the mist generated by the atomizer 230 to the mist generating chamber 130 through the air duct 140 and blows the mist to the ice storage chamber 120. The mist can be diffused in the entire space in the housing 10, and the light generated by the lamp 220 can be added, so that the atmosphere of the environment can be enhanced while the beverage is frozen.

In the present disclosure, the housing 10 is separated from the ice storage chamber 120 and the mist generating chamber 130 by the partition plate 110, which can isolate the ice in the mist generating chamber 130 and the ice storage chamber 120, and can make the mist rise faster; furthermore, by installing a fan 240 and an air duct 140, a mist in the mist generating chamber 130 can be accelerated to be blown out. In this case, the structure not only enables the ice bucket 1 to have misting and luminous effects, but also has better misting effect.

Although the present disclosure has been specifically described above in conjunction with the accompanying drawings and embodiments, it can be understood that the foregoing description does not limit the present disclosure in any form. Those skilled in the art can make deformations and changes to the disclosure as needed without departing from the essential spirit and scope of the disclosure, and these deformations and changes fall within the scope of the disclosure.

What is claimed is:

1. An ice bucket with a spray and light-emitting function, comprising:

a transparent housing; and a light-transmitting base supporting the housing, wherein the housing is separated from an ice storage chamber and a mist generating chamber by a partition plate, the ice storage chamber are in partial communication with the mist generating chamber via the partition plate, and the mist generating chamber is in communication with the base through an air duct, and wherein the base is provided with a power source, a lamp, an atomizer, and a fan, the lamp, the atomizer, and the fan are electrically connected to a power source, the fan is configured to blow a mist generated by the atomizer out of the mist generating chamber through the air duct and guide the mist to the ice storage chamber, and a light generated by the lamp is irradiated to the housing through the base.

2. The ice bucket according to claim 1, wherein the atomizer is composed of a plurality of ultrasonic atomization sheets, and the plurality of ultrasonic atomization sheets are evenly distributed on a surface of the base facing the mist generating chamber.

3. The ice bucket according to claim 1, wherein the atomizer is composed of a plurality of microporous atomizing sheets, and the plurality of microporous atomizing sheets are evenly distributed on a surface of the base facing the mist generating chamber.

4. The ice bucket according to claim 1, wherein the lamp is a strip-shaped light strip, the light strip is arranged on a bottom surface of the base, and a light emitted by the light strip is evenly guided to the transparent housing.

5. The ice bucket according to claim 1, wherein the lamp is a plurality of lamp beads, the plurality of lamp beads are evenly arranged on a bottom surface of the base, and a light emitted by the plurality of lamp beads is evenly guided to the transparent housing.

6. The ice bucket according to claim 1, further comprising:

a housing cover arranged on the housing, and the housing cover is hinged with the housing through a hinge.

7. The ice bucket according to claim 1, wherein a charging port and a power switch are provided on the base.

8. The ice bucket according to claim 1, wherein the power source is a battery.

9. The ice bucket according to claim 1, wherein an outer shape of the housing is one of a cuboid, a cube and a cylinder.

10. The ice bucket according to claim 1, wherein the housing and the base are connected by one of snapping, bonding, bolts, pins, and sliding buckles.

* * * * *